United States Patent [19]

Kawar

[11] Patent Number: 4,892,306

[45] Date of Patent: Jan. 9, 1990

[54] ELECTRICAL HAND STEADINESS TESTING GAME

[76] Inventor: Ibrahim M. Kawar, 2411 Glenallen Ave. H90 204, Silver Spring, Md. 20906

[21] Appl. No.: 355,429

[22] Filed: May 23, 1989

[51] Int. Cl.[4] ..... A63F 9/00

[52] U.S. Cl. ..... 273/1 GA

[58] Field of Search ..... 273/1 GA

[56] References Cited

U.S. PATENT DOCUMENTS

| | | | |
|---|---|---|---|
| 2,508,146 | 5/1950 | D'Elia | 273/1 GA |
| 2,521,500 | 9/1950 | Brauno | 273/1 GA X |
| 2,958,956 | 11/1960 | Olalainty | 273/1 GA X |
| 3,208,747 | 9/1965 | Kawakas | 273/1 GA |
| 3,913,909 | 10/1975 | Bissell | 273/1 GA |
| 4,239,213 | 12/1980 | Jarvis | 273/1 GA |

OTHER PUBLICATIONS

Kenner Products Co. Advertising Playthings, Aug., 1959, p. 52, Beat the Buzz.

*Primary Examiner*—Paul E. Shapiro
*Attorney, Agent, or Firm*—Jerry T. Kearns

[57] ABSTRACT

An electrical hand steadiness testing game includes a base having a pair of spaced upstanding supports. An electrically conductive track member extends between the supports and defines an irregular path for movement of a ring member which surrounds the track member. An insulated manually manipulable handle is secured to the ring. The track and ring members are operably connected with a power supply and visual and audible signals for activation upon contact of the ring member with the track member. The track member may be formed from a plurality of sequentially stepped diameter adjustably interconnected segments to allow adjustment of the path of movement of the ring member. The segments may be electrically insulated and connected in independent circuits to activate separate signals upon contact of the ring member with the corresponding segments.

10 Claims, 3 Drawing Sheets

ELECTRICAL HAND STEADINESS TESTING GAME

BACKGROUND OF THE INVENTION

1. Field of the Invention

The present invention relates to steadiness testing games, and more particularly pertains to an improved electrical steadiness testing game of the type in which an indicating signal is actuated by an electrical contact circuit to indicate undue shaking movements of a manually manipulated electrical contact element. The present invention provides an amusing game which may be reconfigured to regulate the difficulty level to provide physical training for improvement of motor skills and eye-hand coordination.

2. Description of the Prior Art

Various types of steadiness testing games are known in the prior art. A typical example of such a steadiness testing game is to be found in U.S. Pat. No. 2,508,146, which issued to S. D'Elia on May 16, 1950. This patent discloses an amusement slot machine for testing hand steadiness in which an electrical contact ring is manually manipulated for movement upon a path defined by a metallic electrically conductive vertical post. U.S. Pat. No. 3,208,747, which issued to J. Kavakos on Sept. 28, 1965, discloses an electrically operated game in which a ring is manually manipulated along a contact wire. U.S. Pat. No. 3,913,909, which issued to J. Bissell on Oct. 21, 1975, discloses an electronic manual dexterity testing device in which an independent wand or tracer is manually passed over a spiral or helical conductor. U.S. Pat. No. 4,239,213, which issued to A. Jarvis on Dec. 16, 1980, discloses a steadiness testing game in which a convoluted conductive track extends between two upstanding supports. An electrically conductive ring is manually manipulated upon the track and activates an indicating signal upon contact between the ring and track.

While the above mentioned devices are directed to steadiness testing games, none of these devices utilize an adjustable track formed by a plurality of interconnected stepped diameter cylindrical segments. Additionally, none of the aforesaid devices disclose the use of a plurality of adjustable electrically insulated segments which are separately connected in independent circuits to a plurality of different indicating signals. Inasmuch as the art is relatively crowded with respect to these various types of steadiness testing games, it can be appreciated that there is a continuing need for and interest in improvements to such steadiness testing games, and in this respect, the present invention addresses this need and interest.

SUMMARY OF THE INVENTION

In view of the foregoing disadvantages inherent in the known types of steadiness testing games now present in the prior art, the present invention provides an improved electrical hand steadiness testing game. As such, the general purpose of the present invention, which will be described subsequently in greater detail, is to provide a new and improved electrical hand steadiness testing game which has all the advantages of the prior art steadiness testing games and none of the disadvantages.

To attain this, representative embodiments of the concepts of the present invention are illustrated in the drawings and make use of an electrical hand steadiness testing game including a base having a pair of spaced upstanding supports. An electrically conductive track member extends between the supports and defines an irregular path for movement of a ring member which surrounds the track member. An insulated manually manipulable handle is secured to the ring. The track and ring members are operably connected with a power supply and visual and audible signals for activation upon contact of the ring member with the track member. The track member may be formed from a plurality of sequentially stepped diameter adjustably interconnected segments to allow adjustment of the path of movement of the ring member. The segments may be electrically insulated and connected in independent circuits to activate separate signals upon contact of the ring member with the corresponding segments.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical hand steadiness testing game which has all the advantages of the prior art steadiness testing games and none of the disadvantages.

It is another object of the present invention to provide a new and improved electrical hand steadiness testing game which may be easily and efficiently manufactured and marketed.

It is a further object of the present invention to provide a new and improved electrical hand steadiness testing game which is of a durable and reliable construction.

An even further object of the present invention is to provide a new and improved electrical hand steadiness testing game which is susceptible of a low cost of manufacture with regard to both materials and labor, and which accordingly is then susceptible of low prices of sale to the consuming public, thereby making such steadiness testing games economically available to the buying public.

Still yet another object of the present invention is to provide a new and improved electrical hand steadiness testing game which provides in the apparatuses and methods of the prior art some of the advantages thereof, while simultaneously overcoming some of the disadvantages normally associated therewith.

Still another object of the present invention is to provide a new and improved electrical hand steadiness testing game which provides an amusing training device for developing eye-hand coordination and motor skills.

Yet another object of the present invention is to provide a new and improved electrical hand steadiness testing game having an adjustable movement track to regulate the difficulty of the game.

Even still another object of the present invention is to provide a new and improved electrical steadiness testing game having a movement track formed by a plurality of stepped diameter electrically insulated adjustably interconnected segments.

These together with other objects of the invention, along with the various features of novelty which characterize the invention, are pointed out with particularity in the claims annexed to and forming a part of this disclosure. For a better understanding of the invention, it operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
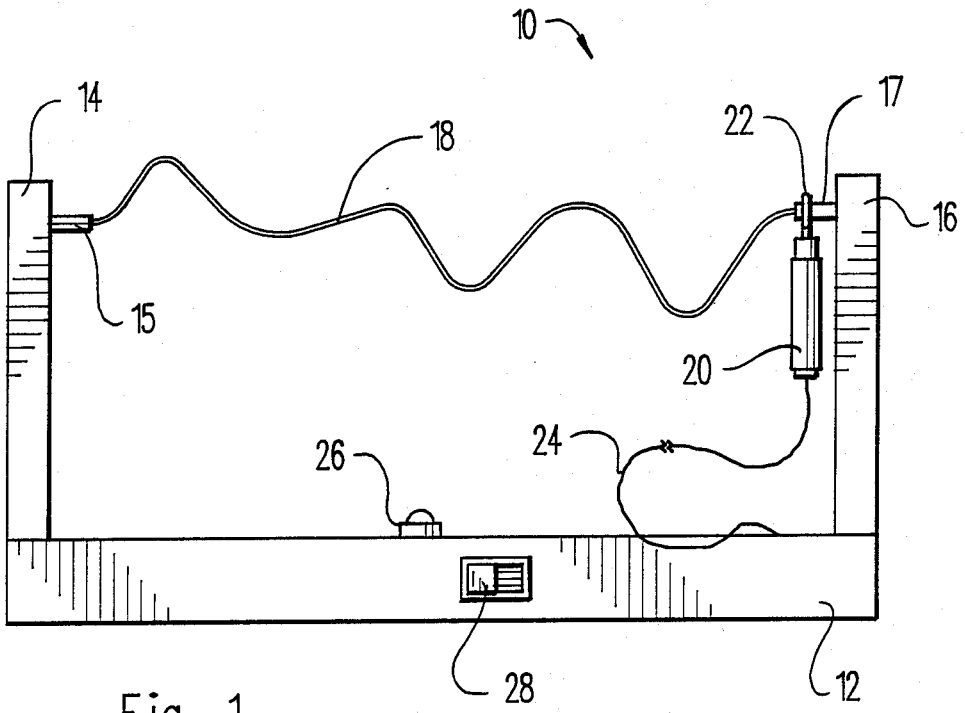
FIG. 1 is a side view illustrating an electrical hand steadiness testing game according to a first embodiment of the present invention.

With reference now to the drawings, and in particular to FIG. 1 thereof, a new and improved electrical hand steadiness testing game embodying the principles and concepts of the present invention and generally designated by the reference numeral 10 will be described.

More specifically, it will be noted that the first embodiment 10 of the invention includes a base 12 having a pair of spaced parallel vertically upstanding supports 14 and 16. Electrically insulated cylindrical rest pegs 15 and 17 project toward each other in coaxial relation from the respective supports 14 and 16. A track member 18 is formed from a deformable electrically conductive metallic wire which projects from and extends through the rest members 15 and 17 and extends through a hollow interior portion of the supports 14 and 16 for connection with the remaining electrical components located within the hollow interior of the base 12. A metallic electrically conductive ring member 22 is received around the track member 18 for movement therealong, between the rest members 15 and 17. The ring member has a diameter which is greater than the track member 18 to allow the ring 22 to be manually manipulated therealong by an individual grasping an electrically insulated handle 20. The ring member 22 is connected by an insulated electrical wire 24 to the electrical components located within the interior of the base 12. An electrical indicating light 26 is operably connected with a battery power supply within the base 12 for actuation upon contact of the ring member 22 with the track member 18. A switch 28 is provided for disconnecting the power supply when the game is not in use.

Figure 2:
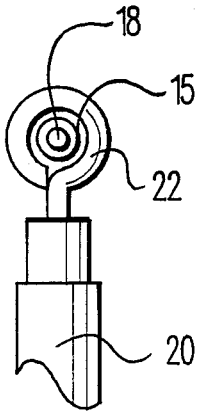
FIG. 2 is a detail view illustrating the assembled relation between the electrically conductive ring and track members.

FIG. 2 illustrates the relation of the ring member 22 with one of the rest members 15 and the electrically conductive wire track member 18.

Figure 3:
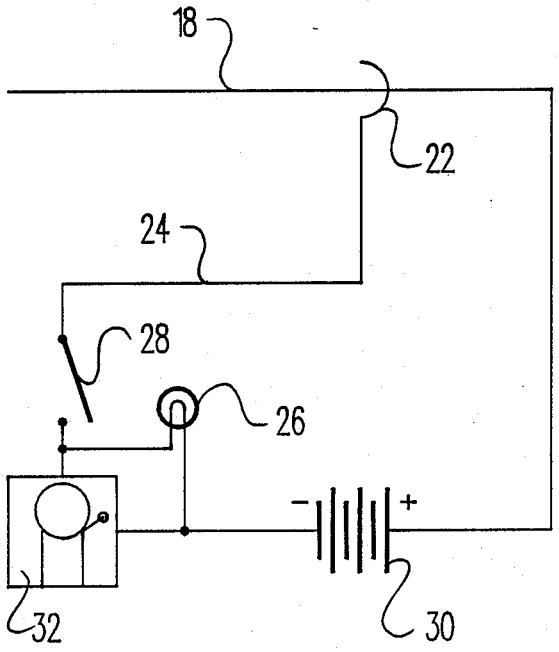
FIG. 3 is a schematic diagram illustrating the connection of the electrical components of the steadiness testing game of FIG. 1.

FIG. 3 is a schematic diagram showing the operative connection of the electrical components of the game of FIG. 1. A conventional battery 30, such as a small nine volt battery, is connected to an electrical indicator light 26 and an audible alarm 32, both located within the interior of the base 12. The ring member 22 is connected by the wire 24 to the switch 28. When the switch 28 is closed, contact of the ring member 22 with the track member 18 will complete the circuit, simultaneously activating the audible signal 32 and the visual signal 26. The audible signal may take a variety of forms, for example a small buzzer or a bell may be utilized. Similarly, the visual signal 26 may comprise an LED or other conventional electrically illuminated lamps.

Figure 4:
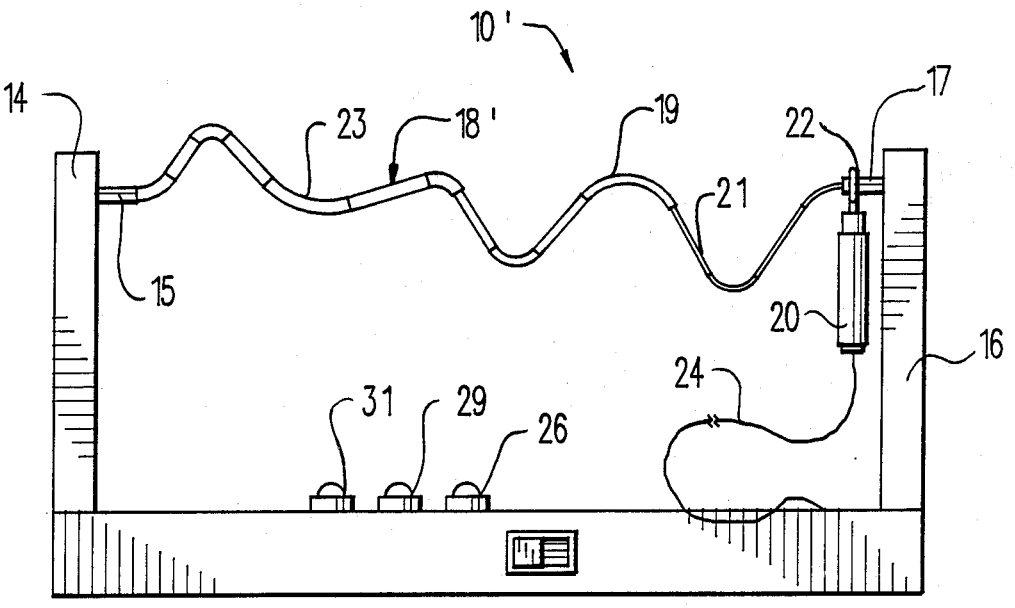
FIG. 4 is a side view illustrating an electrical steadiness testing game according to a second embodiment of the present invention.

FIG. 4 illustrates a second embodiment 10′ of the invention, in which the same reference numerals have been utilized to designate like parts. In the second embodiment 10′, the track member 18′ is formed by a plurality of sequentially stepped diameter portions 21, 19 and 23. Each of the portions 21, 19 and 23 are formed by a pluralitY of adjustably interconnected cylindrical metallic tubular segments. The stepped diameter of the track 18′ forms a movement path of increasing difficulty between the rest member 17 and the rest member 15. As the diameter of the track 18 increases from the smallest diameter portion 21 to the intermediate diameter portion 19 and the largest diameter portion 23, the clearance between the track 18′ and the ring 22 diminishes, requiring an increased degree of precision in moving the ring 22 along the track 18′. A plurality of separate visual indicators 26, 29 and 31 may be independently connected with the segments 21, 19 and 23, to indicate at which point the ring member 22 has contacted the track member 18'. The adjustable interconnection of the tubular segments utilized to form the track member 18' allows the configuration of the movement path to be selectively altered, thus regulating the difficulty of the game.

Figure 5:
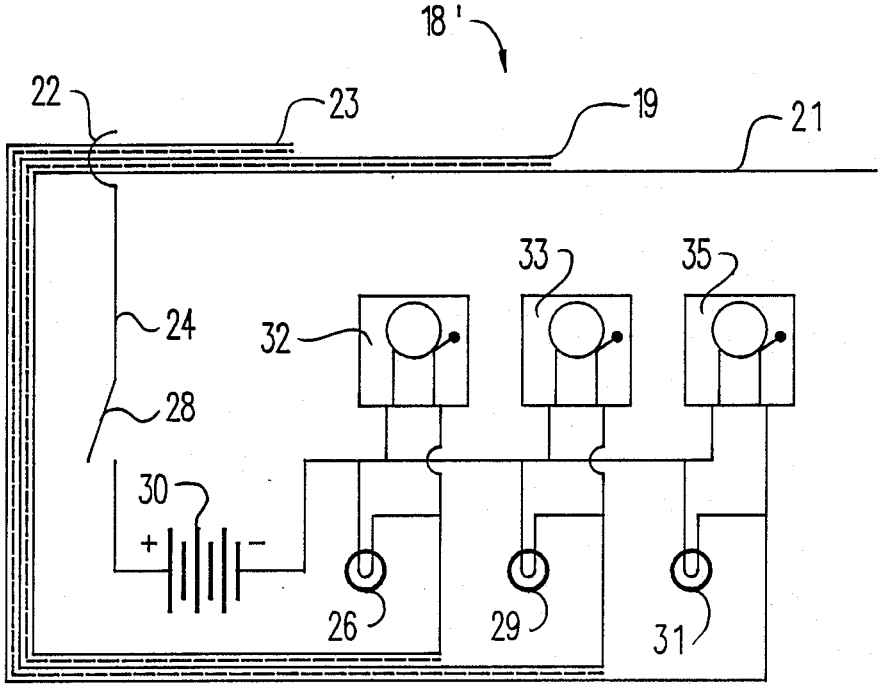
FIG. 5 is a schematic diagram illustrating the connection of the electrical components of the game of FIG. 4.

FIG. 5 illustrates an exemplary schematic diagram for the electrical components which may be utilized in conjunction with the game 10' illustrated in FIG. 4. Each of the segments 21, 19 and 23 of the movement track member 18' form electrically insulated independent circuit paths. Upon contact of the ring member 22 with the smallest diameter portion 21, the visual signal light 31 and audible alarm 35 will be activated. Similarly, upon contact of the ring member 22 with the intermediate diameter track portion 19, the visual indicating light 29 and the audible alarm 33 will be activated. Finally, upon contact of the ring member 22 and the large diameter track portion 23, the indicating light 26 and audible alarm 32 will be activated. It should be noted that the illustrated circuit diagram is intended to be exemplary only, and a larger or smaller number of separate independent track portions and distinct indicating signals may be employed, without departing from the scope of the present invention. It is additionally contemplated that the visual indicating signals 26, 29 and 31 may comprise illuminated verbal messages which indicate the appropriate skill level of the player. Also, the audible signals may have different tones to indicate the extent of progress along the track 18'.

Figure 6:
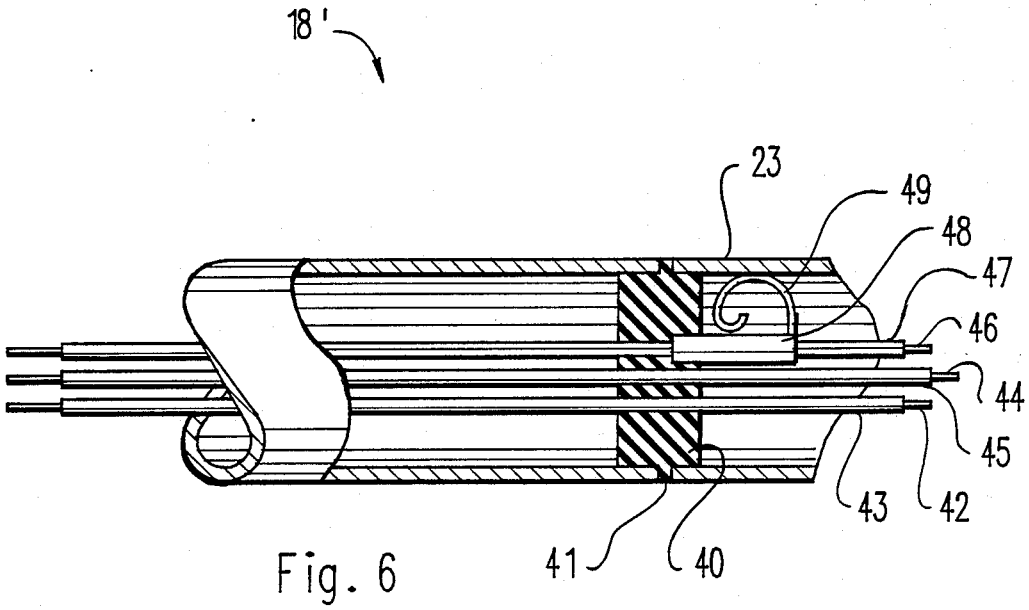
FIG. 6 is an enlarged detail view, partially cut away and in cross section, illustrating the construction of the electrically conductive track member of the game illustrated in FIG. 4.

FIG. 6 is a detail view showing the interconnection of two adjacent segments forming the largest diameter portion 23 of the track member 18' illustrated in FIG. 4. The track member 18' is formed by a plurality of hollow metallic tubular members. An electrically insulating rubber disk 40 has an intermediate radial flange 41 which is received between end portions of adjacent tubular segments. This allows the adjacent segments to be rotated while maintaining electrical insulation. As required, a bridging contact is formed between adjacent tubular segments within each of the independent circuit portions. A plurality of electrically conductive wires 42, 44 and 46 extend through the interior of the tubular members and include electrical insulating layers 43, 45 and 47. The appropriate wire, for example 46, may be electrically connected with the metallic tubular member within the circuit portion 23 by a metallic connecting sleeve 48 having a leaf spring electrical contact 49. The contact 49 has a sharpened point which pierces the insulating layer 47 and makes an electrical connection with the wire 46. The leaf spring type contact 49 ensures freedom of movement of the tubular segment, while ensuring electrical contact.

Figure 7:
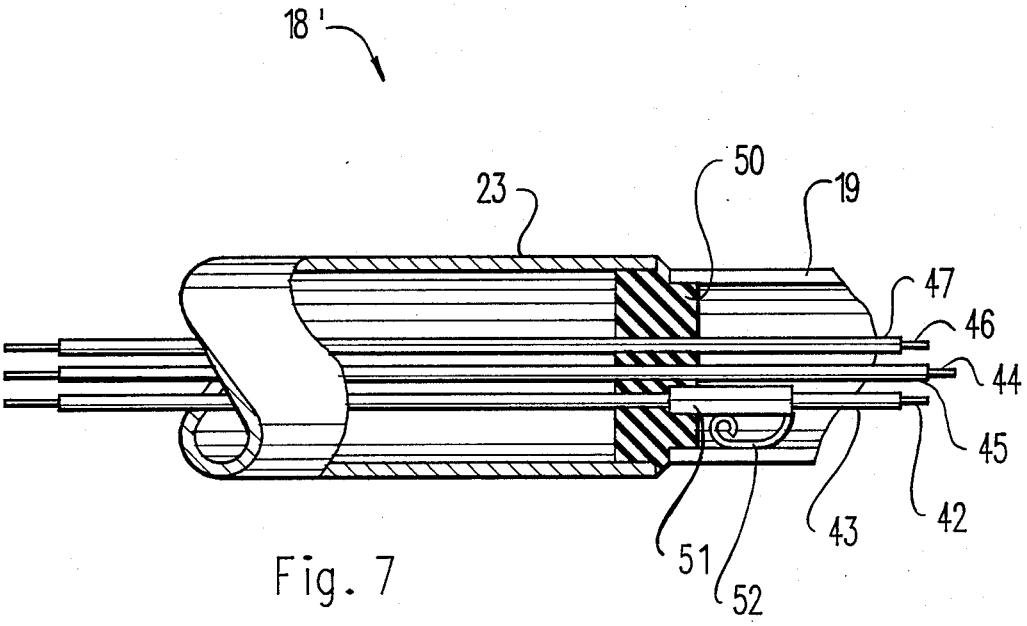
FIG. 7 further illustrates the construction of the electrically conductive track member of the game of FIG. 4.

FIG. 7 illustrates an additional detail view of the track member 18' in which a stepped diameter rubber insulating disk 50 is utilized to connect and insulate stepped diameter track portions 19 and 23.

As may now be understood, the second embodiment 10' provides an electrical hand steadiness testing device having a wide degree of flexibility to allow adjustment of the difficulty level of the game.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electrical steadiness testing game, comprising:
a base;
a pair of spaced upstanding supports on said base;
a plurality of sequentially stepped diameter cylindrical segments interconnected to form an electrically conductive track member between said supports;
means rotatably connecting at least some adjacent segments of said track member to allow changing of a path defined by said track member;
an electrically conductive ring member received around said track member;
an insulated manually manipulable handle secured to said ring member;
power supply means; and
indicating means operably connected with said power supply means, said track member and said ring member for actuation upon contact of said ring member with said track member.

2. The electrical hand steadiness testing game of claim 1, further comprising a plurality of independently actuated indicating means;
and
means insulating said different diameter segments and connecting each of said different diameter segments in independent circuits for separately activating a corresponding one of said plurality of indicating means upon contact with said ring member.

3. The electrical hand steadiness testing game of claim 2, wherein said segments comprise hollow metallic tubes and a plurality of insulated wires extend through said tubes and separately connect said segments with said plurality of indicating means to form said independent circuits.

4. The electrical hand steadiness testing game of claim 1, wherein at least two of said segments are electrically insulated from each other.

5. The electrical hand steadiness testing game of claim 4, further comprising a plurality of indicating means connected for independent actuation by contact with said insulated segments.

6. An electrical steadiness testing game, comprising:
a base;
a pair of spaced upstanding supports on said base;
a plurality of cylindrical segments interconnected to form an electrically conductive track member between said supports, at least some of said segments having an arcuate curvature;
means rotatably connecting at least some adjacent segments of said track member to allow changing of a path defined by said track member;
an electrically conductive ring member received around said track member;

an insulated manually manipulable handle secured to said ring member;

power supply means;

and indicating means operably connected with said power supply means, said track member and said ring member for actuation upon contact of said ring member with said track member.

7. The electrical hand steadiness testing game of claim 6, further comprising a plurality of independently actuated indicating means;

and means insulating at least some of said different segments and connecting said insulated different segments in independent circuits for separately activating a corresponding one of said plurality of indicating means upon contact with said ring member.

8. The electrical hand steadiness testing game of claim 7, wherein said segments comprise hollow metallic tubes and a plurality of insulated wires extend through said tubes and separately connect said segments with said plurality of indicating means to form said independent circuits.

9. The electrical hand steadiness testing game of claim 6, wherein at least two of said segments are electrically insulated from each other.

10. The electrical hand steadiness testing game of claim 9, further comprising a plurality of indicating means connected for independent actuation by contact with said insulated segments.

* * * * *